US010514046B2

(12) United States Patent
Stauter et al.

(10) Patent No.: US 10,514,046 B2
(45) Date of Patent: Dec. 24, 2019

(54) AIR MANAGEMENT SYSTEM FOR THE OUTDOOR UNIT OF A RESIDENTIAL AIR CONDITIONER OR HEAT PUMP

(71) Applicant: Carrier Corporation, Jupiter, FL (US)

(72) Inventors: Richie C. Stauter, Fayetteville, NY (US); Peter R. Bushnell, Cazenovia, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 453 days.

(21) Appl. No.: 15/288,025

(22) Filed: Oct. 7, 2016

(65) Prior Publication Data

US 2017/0102007 A1 Apr. 13, 2017

Related U.S. Application Data

(60) Provisional application No. 62/239,581, filed on Oct. 9, 2015, provisional application No. 62/370,888, filed on Aug. 4, 2016.

(51) Int. Cl.

| | |
|---|---|
| ***F04D 29/70*** | (2006.01) |
| ***F04D 29/54*** | (2006.01) |
| ***F24F 1/16*** | (2011.01) |
| ***F24F 1/40*** | (2011.01) |
| ***F04D 29/58*** | (2006.01) |
| ***F24F 1/38*** | (2011.01) |
| ***F24F 1/50*** | (2011.01) |
| ***F04D 19/00*** | (2006.01) |

(52) U.S. Cl.

CPC ..... *F04D 29/703* (2013.01); *F04D 19/002* (2013.01); *F04D 29/542* (2013.01); *F04D 29/547* (2013.01); *F04D 29/5826* (2013.01); *F24F 1/16* (2013.01); *F24F 1/38* (2013.01); *F24F 1/40* (2013.01); *F24F 1/50* (2013.01); *F05B 2240/133* (2013.01); *F05B 2260/20* (2013.01); *F05B 2260/96* (2013.01)

(58) Field of Classification Search

CPC ..... F24F 1/14; F24F 1/16; F24F 1/38; F24F 1/40; F24F 1/50; F04D 29/703; F04D 29/547; F04D 29/5826; F04D 19/002; F01D 25/02

See application file for complete search history.

(56) References Cited

U.S. PATENT DOCUMENTS 3,103,796 A * 9/1963 Dickson ..... A47F 3/0447 62/199
4,340,115 A * 7/1982 Wright ..... F24F 1/18 165/122

(Continued)

FOREIGN PATENT DOCUMENTS

CN 103912926 A 7/2014
EP 2535660 A2 * 12/2012 ..... F24F 1/38

(Continued)

*Primary Examiner* — Richard A Edgar
*Assistant Examiner* — Topaz L. Elliott
(74) *Attorney, Agent, or Firm* — Cantor Colburn LLP

(57) ABSTRACT

A fan assembly includes a fan housing having an inlet and an outlet. A recess formed in the inlet is configured to receive a portion of a heat exchanger. A fan rotor is positioned within the housing and is configured to rotate about a fan axis. The fan rotor includes a hub having a plurality of fan blades mounted thereto.

19 Claims, 7 Drawing Sheets

(56) References Cited

U.S. PATENT DOCUMENTS

| | | | | |
|---|---|---|---|---|
| 5,117,656 | A | 6/1992 | Keck et al. | |
| 6,045,327 | A * | 4/2000 | Amr | F04D 25/08 415/191 |
| 6,764,277 | B2 | 7/2004 | Somahara et al. | |
| 7,819,563 | B2 * | 10/2010 | Hardgrave | F04D 25/088 362/294 |
| 8,092,156 | B2 | 1/2012 | Jang et al. | |
| 8,137,059 | B2 | 3/2012 | Kim et al. | |
| 2009/0193831 | A1 | 8/2009 | Kim et al. | |
| 2011/0072844 | A1 | 3/2011 | Wang | |
| 2014/0161597 | A1 * | 6/2014 | Thise | F01D 25/02 415/176 |
| 2014/0338858 | A1 * | 11/2014 | Kuo | H01L 23/3677 165/67 |
| 2015/0007605 | A1 * | 1/2015 | Masui | F25B 39/00 62/508 |
| 2015/0184871 | A1 * | 7/2015 | Yabe | F04D 25/082 62/428 |
| 2015/0184872 | A1 | 7/2015 | Oh et al. | |
| 2016/0032942 | A1 * | 2/2016 | Jung | F04D 29/563 415/148 |
| 2017/0205084 | A1 * | 7/2017 | Eskew | F24F 1/16 |

FOREIGN PATENT DOCUMENTS

| | | | |
|---|---|---|---|
| JP | 2007147207 | A | 6/2007 |
| JP | 2012042141 | A | 3/2012 |
| JP | 2012207819 | A | 10/2012 |
| JP | 2012225537 | A | 11/2012 |
| JP | 2013122335 | A | 6/2013 |
| JP | 2014105901 | A | 6/2014 |
| JP | 2014105971 | A | 6/2014 |
| JP | 2014105972 | A | 6/2014 |
| KR | 100765557 | B1 * | 10/2007 |

* cited by examiner

AIR MANAGEMENT SYSTEM FOR THE OUTDOOR UNIT OF A RESIDENTIAL AIR CONDITIONER OR HEAT PUMP

CROSS-REFERENCE TO RELATED APPLICATION

This application is related to and claims the benefit of U.S. Provisional Patent Application Ser. No. 62/239,581 filed on Oct. 9, 2015 and U.S. Provisional Patent Application Ser. No. 62/370,888 filed on Aug. 4, 2016, the entire contents of which are herein incorporated by reference.

BACKGROUND

This disclosure relates generally to outdoor units for air conditioners and heat pumps used to control the air temperature and humidity within a space and, more particularly, to a fan assembly of an outdoor unit adapted to reduce sound and flow losses Air cooled condensers, commonly used in residential air conditioning systems, employ a fin tube construction to transfer heat from the refrigerant to the outdoor air. As hot, high pressure refrigerant passes through the coil, heat from the compressed refrigerant is transferred through the tubes to the attached fins. A fan is used to draw outside air across the finned heat transfer surfaces to remove heat from the refrigerant. In heat pump applications, the same outdoor unit operates in a similar manner, except that the heat exchanger operates as an evaporator rather than a condenser.

The planform of a heat exchanger coil of an outdoor unit is usually round, rectangular, or square in form, and the compressor is normally disposed within the coil. A fan and its drive motor are commonly mounted above the heat exchanger such that the fan draws outdoor air inwardly through the coil and then upwardly to be discharged into the atmosphere.

SUMMARY

According to a first embodiment, a fan assembly includes a fan housing having an inlet and an outlet. A recess formed in the inlet is configured to receive a portion of a heat exchanger. A fan rotor is positioned within the housing and is configured to rotate about a fan axis. The fan rotor includes a hub having a plurality of fan blades mounted thereto.

In addition to one or more of the features described above, or as an alternative, in further embodiments a ratio of a diameter of the fan rotor to a height extending between the inlet and outlet of the housing is between about 2 and 5.

In addition to one or more of the features described above, or as an alternative, in further embodiments the fan housing includes a converging section adjacent the inlet end and a diverging section adjacent the discharge end.

In addition to one or more of the features described above, or as an alternative, in further embodiments the fan rotor is positioned within the housing such that the plurality of fan blades are arranged adjacent an intersection between the converging section and the diverging section.

In addition to one or more of the features described above, or as an alternative, in further embodiments a throat is defined in the housing between the converging section and the diverging section, and a ratio of a cross-sectional area of throat to a cross-sectional area of the housing at the outlet is between about 0.5 and 1.

In addition to one or more of the features described above, or as an alternative, in further embodiments the converging section of the housing has a generally elliptical shape including a profile major axis and a profile minor axis, wherein a ratio of the profile major axis to the profile minor axis is between about 1 and 3.

In addition to one or more of the features described above, or as an alternative, in further embodiments the converging section of the housing has a generally elliptical shape including a profile major axis and a profile minor axis, wherein a ratio of the profile major axis to a diameter of the fan rotor is between about 0.05 and about 0.25.

In addition to one or more of the features described above, or as an alternative, in further embodiments the housing adjacent the inlet includes a substantially horizontally and radially extending surface, wherein the recess is formed within the substantially horizontally and radially extending surface.

In addition to one or more of the features described above, or as an alternative, in further embodiments the recess has a vertical depth between about 2 mm and 40 mm.

In addition to one or more of the features described above, or as an alternative, in further embodiments at least a portion of a heat exchanger is receivable within the recess, an upper edge of the heat exchanger being positioned between 2 mm and 8 mm within the recess.

In addition to one or more of the features described above, or as an alternative, in further embodiments a header of a heat exchanger tube is receivable within the recess, an upper edge of the header being positioned between 10 mm and 40 mm within the recess.

In addition to one or more of the features described above, or as an alternative, in further embodiments including a stator assembly located adjacent the outlet, the stator assembly including a plurality of outlet guide vanes.

In addition to one or more of the features described above, or as an alternative, in further embodiments including a finger guard connected to the outlet of the housing, wherein the plurality of outlet guide vanes are integrated with the finger guard.

In addition to one or more of the features described above, or as an alternative, in further embodiments the housing is formed from a first housing section and a second housing section coupled together.

In addition to one or more of the features described above, or as an alternative, in further embodiments at least one of the first housing section and the second housing section is formed from a plastic material.

In addition to one or more of the features described above, or as an alternative, in further embodiments at least one of the first housing section and the second housing section is formed from a metal material.

According to another embodiment, an outdoor coil unit includes a heat exchanger having a first header, a second header, and a plurality of heat exchange tube segments extending between and fluidly coupling the first header and the second header. A fan is mounted to a portion of the heat exchanger. The fan includes a housing having an inlet and an outlet. A recess is formed in the housing adjacent the inlet. A portion of the heat exchanger is positioned within the recess. A fan rotor is positioned within the housing and is configured to rotate about a fan axis. The fan rotor includes a hub having a plurality of fan blades mounted thereto.

In addition to one or more of the features described above, or as an alternative, in further embodiments the heat exchanger has a multi-pass configuration.

In addition to one or more of the features described above, or as an alternative, in further embodiments the fan assembly includes a fan motor operably coupled to the fan rotor, a floor pan configured to hold the heat exchanger, a grille coupled to the discharge end of the housing, or a combination comprising at least one of the foregoing.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

One way to increase the efficiency of a coil unit and decrease the volume of refrigerant used therein, is by achieving a greater amount of heat transfer per surface area. This increased heat transfer requires significantly higher heat exchanger face velocities, which further imposes higher requirements on an air management system.

Figure 1:
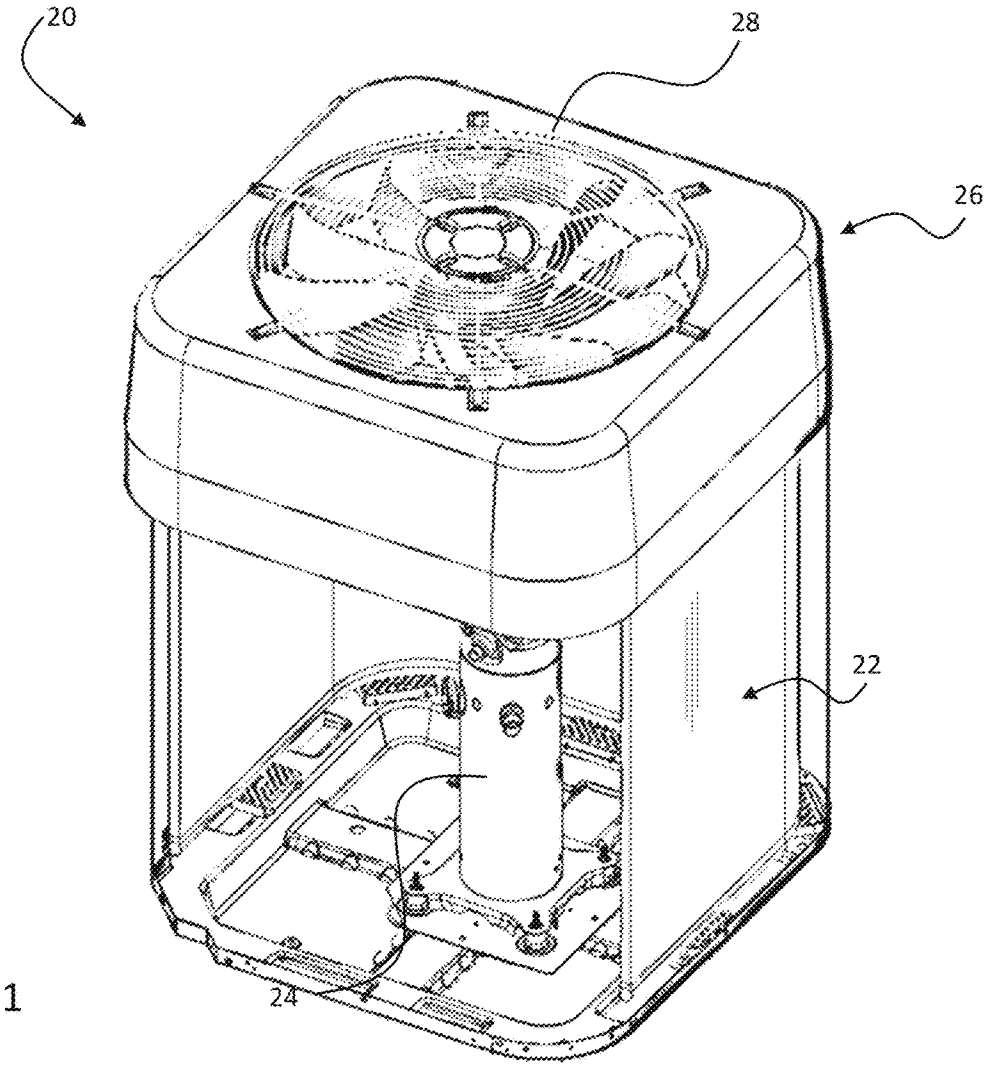
FIG. 1 is an example of an coil unit according to an embodiment.

Referring now to FIG. 1, a coil unit 20 of an air conditioning system is illustrated. The coil unit 20 includes a heat exchanger 22 where the planform is a generally square structure, although embodiments where the planform of the heat exchanger 22 is rectangular, cylindrical, or another shape are also within the scope of the disclosure. A compressor 24, fluidly coupled to the heat exchanger 22 is positioned within the interior of the heat exchanger 22 and is configured to pump refrigerant through a vapor compression cycle. Disposed in contact with a surface of the heat exchanger 22 is a fan assembly 26 configured to draw ambient air radially inward, through the heat exchanger 22, after which the warmer air is discharged upwardly through an opening 28. In an embodiment, the unit 20 may include a floor pan may be configured to hold the heat exchanger 22 in place.

Figure 2:
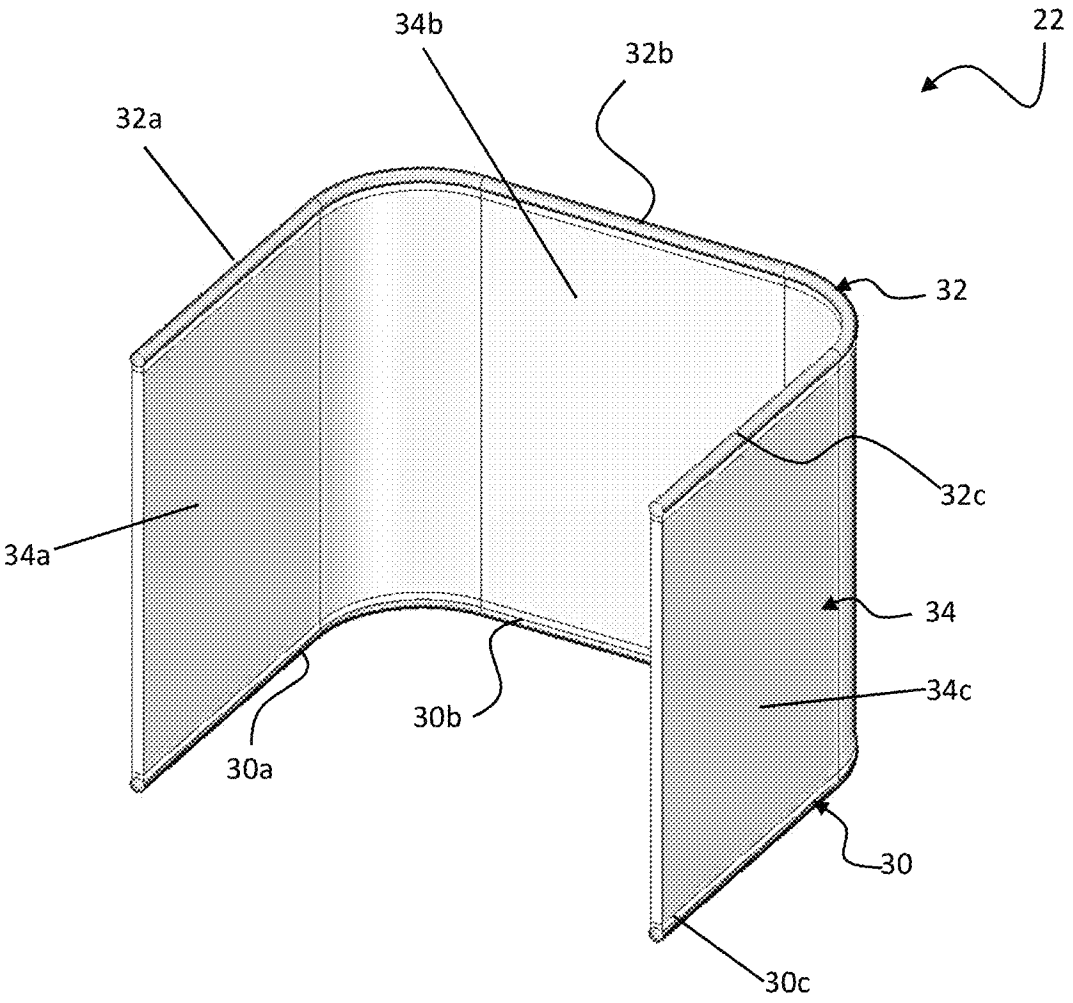
FIG. 2 is a perspective view of the heat exchanger of the outdoor unit of FIG. 1 according to an embodiment.
Figure 3:
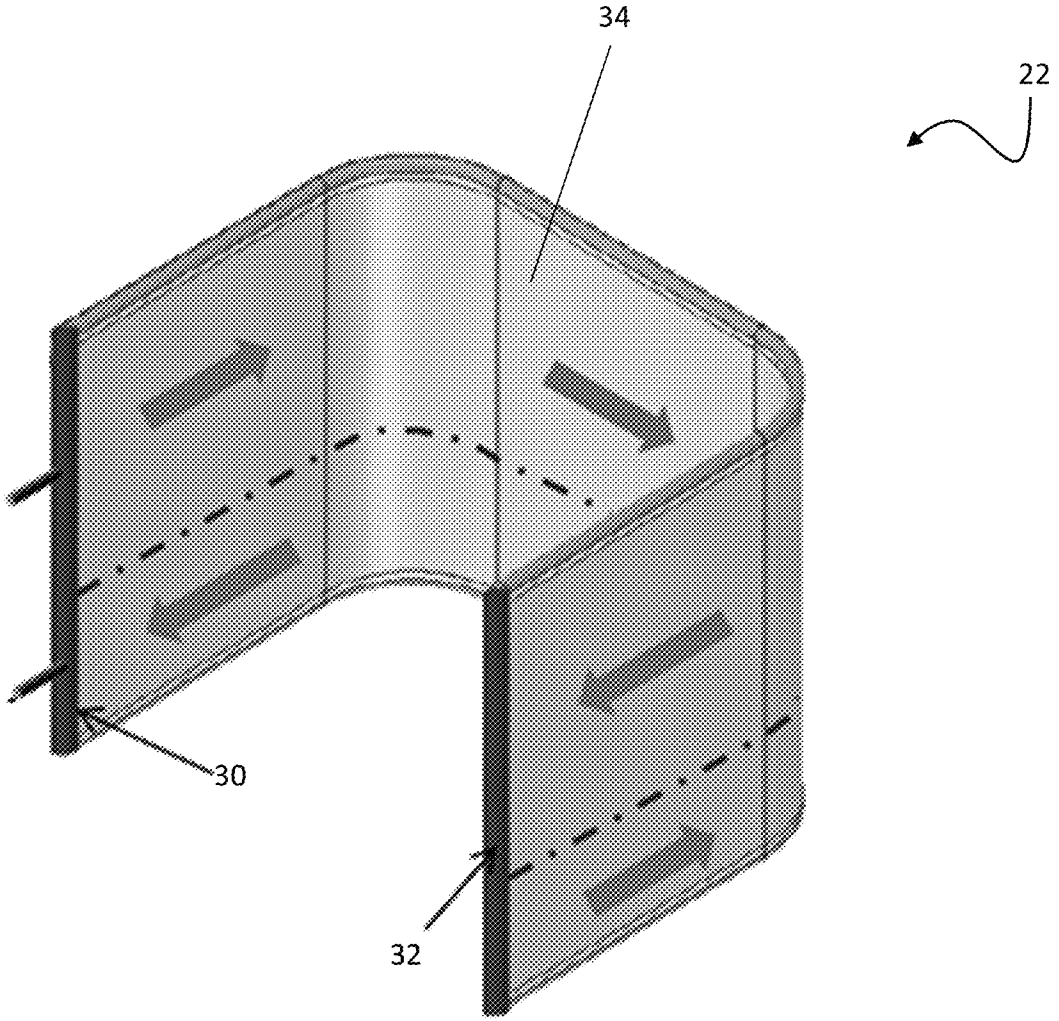
FIG. 3 is a perspective view of the heat exchanger of the outdoor unit of according to an embodiment.

With reference now to FIG. 2, an example of a heat exchanger 22 of the coil unit 20 is illustrated in more detail. The heat exchanger 22 includes a first manifold or header 30, a second manifold or header 32 spaced apart from the first manifold 30, and a plurality of heat exchange tubes 34 extending in a spaced parallel relationship between and fluidly connecting the first manifold 30 and the second manifold 32. In the illustrated, non-limiting embodiments, the first header 30 and the second header 32 are oriented generally horizontally or level and are bent to form a heat exchanger 22 having a desired shape (e.g., a "C", "U", "V", "W", or "J" shape). The heat exchange tubes 34 extend generally vertically between the two headers 30, 32. By arranging the tubes 34 vertically, as shown in FIG. 2, water condensate collected on the tubes 34 is more easily drained from the heat exchanger 22. However, in other embodiments, a heat exchanger 22 having another configuration, such as where the headers 30, 32 are arranged vertically and the plurality of heat exchanger tubes 34 extend horizontally for example, are within the scope of the disclosure.

In the non-limiting embodiments illustrated in the FIGS., the headers 30, 32 comprise hollow, closed end cylinders having a circular cross-section. However, headers 30, 32 having other configurations, such as a semi-elliptical, square, rectangular, hexagonal, octagonal, or other cross-sections for example, are within the scope of the disclosure. The heat exchanger 22 may be used as either a condenser or an evaporator in a vapor compression system, such as a heat pump system or air conditioning system for example.

Figure 4:
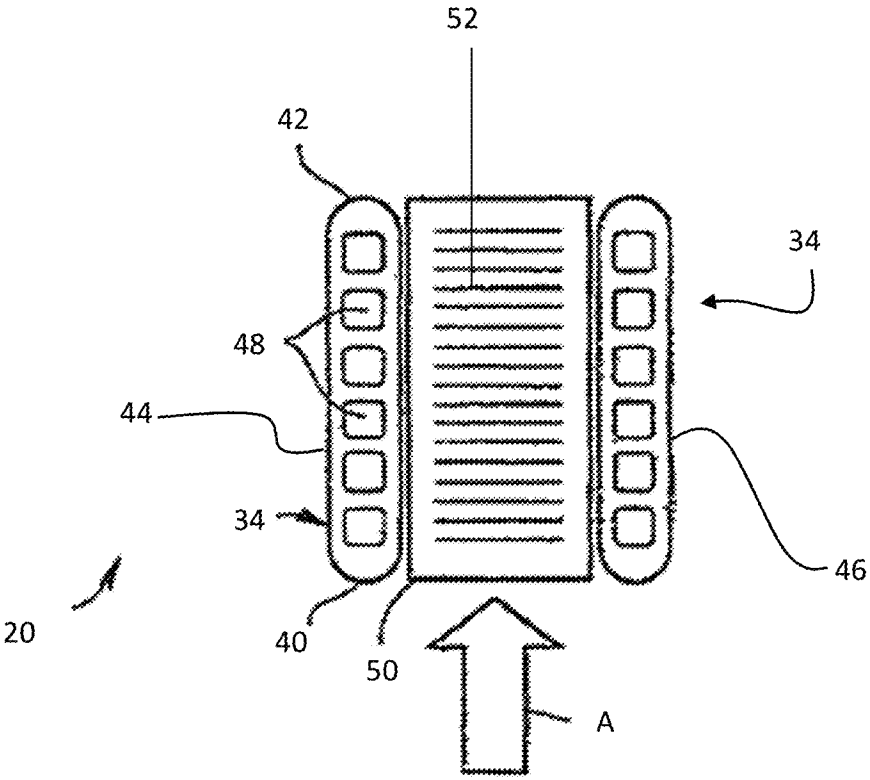
FIG. 4 is a cross-sectional view of a portion of the heat exchanger of FIG. 2.

The heat exchanger 22 can be any type of heat exchanger. The heat exchanger 22 can be a round tube plate fin (RTPF) type heat exchanger or a microchannel heat exchanger to name a few non-limiting examples. Referring now to FIG. 4, in embodiments where the heat exchanger 22 is a microchannel heat exchanger, each heat exchange tube 34 comprises a flattened heat exchange tube having a leading edge 40, a trailing edge 42, a first surface 44, and a second surface 46. The leading edge 40 of each heat exchanger tube 34 is upstream of its respective trailing edge 42 with respect to an airflow A through the heat exchanger 22. The interior flow passage of each heat exchange tube 34 may be divided by interior walls into a plurality of discrete flow channels 48 that extend over the length of the tubes 34 from an inlet end to an outlet end and establish fluid communication between the respective first and second manifolds 30, 32. The flow channels 48 may have a circular cross-section, a rectangular cross-section, a trapezoidal cross-section, a triangular cross-section, or another non-circular cross-section. The heat exchange tubes 34 including the discrete flow channels 48 may be formed using known techniques and materials, including, but not limited to, extrusion or folding.

As known, a plurality of heat transfer fins 50 (FIG. 4) may be disposed between and rigidly attached, e.g., by a furnace braze process, to the heat exchange tubes 34, in order to enhance external heat transfer and provide structural rigidity to the heat exchanger 22. The fins 50 may be configured with any of a plurality of configurations. In the illustrated, non-limiting embodiment, each fin 50 is formed from a plurality of connected strips or a single continuous strip of fin material tightly folded in a ribbon-like serpentine fashion thereby providing a plurality of closely spaced fins 52 that extend generally orthogonal to the flattened heat exchange tubes 34. Heat exchange between the fluid within the heat exchanger tubes 34 and the air flow A, occurs through the outside surfaces 44, 46 of the heat exchange tubes 34 collectively forming the primary heat exchange surface, and also through the heat exchange surface of the fins 52 of the folded fin 50, which form the secondary heat exchange surface. It should be understood that the headers 30, 32 of the heat exchanger do not participate, or minimally participate in heat transfer between a fluid within the heat exchanger and the air flow A.

The heat exchanger 22 may be configured with a single or multi-pass flow configuration. To form a multi-pass flow configuration, at least one of the first manifold 30 and the second manifold 32 includes two or more fluidly distinct sections or chambers. In one embodiment, the fluidly distinct sections are formed by coupling separate manifolds together to form the first or second manifold 30, 32. Alternatively, a baffle or divider plate (not shown) known to a person of ordinary skill in the art may be arranged within at least one of the first header 30 and the second header 32 to define a plurality of fluidly distinct sections therein.

in the illustrated, non-limiting embodiment of FIGS. 1 and 2, the heat exchanger 22 is configured with a two-pass flow arrangement. As a result, each of the first header 30 and the second header 32 is generally divided into a first, second, and third section, respectively. A first group 34*a* of heat exchanger tubes 34 extends vertically between the first sections 30*a*, 32*a* of the first and second header 30, 32, a second group 34*b* of heat exchanger tubes 34 extends vertically between the second sections 30*b*, 32*b* of the first and second header 30, 32, and a third group 34*c* of heat exchanger tubes 34 extends vertically between the third sections 30*c*, 32*c* of the first and second header 30, 32. A length of the first and third sections of the headers 30, 32 and the number of tubes 34 within the first and third groups 34*a*, 534 may, but need not be substantially identical.

The direction of fluid flow through the heat exchanger 22 depends on the mode in which the outdoor unit is being operated. For example, when the heat exchanger 22 is configured to operate as an evaporator and heat the fluid therein, a two-phase refrigerant mixture is provided via an inlet (not shown) to the second section 30*b* of the first header 30. Within the second section 30*b*, the refrigerant is configured to flow through the second group 34*b* of tubes 34 to the second section 32*b* of the second header 32. From the second section 32*b* of the second header 32, the fluid flow is configured to divide such that a portion of the fluid flows into the first section 32*a* of the second header 32 and a portion of the fluid flows into the third section 32*c* of the second header 32, and through the first and third groups of tubes 34*a*, 34*c*, respectively. Once received within the first section 30*a* of the first header 30 and the third section 30*c* of the first header 30, the fluid is provided via outlets 60 to a conduit (not shown) where the fluid is rejoined and provided to a downstream component of a vapor compression system.

As the refrigerant flows sequentially through the second and first groups 34*b*, 34*a* of heat exchanger tubes 34, or alternatively, through the second and third groups 34*b*, 34*c* of heat exchanger tubes 34, heat from an adjacent flow of air A, is transferred to the refrigerant. As a result, a substantially vaporized refrigerant is provided at the outlets 60. Alternatively, refrigerant is configured to flow in a reverse direction through the heat exchanger 22 when operated as a condenser. The heat exchanger configuration illustrated and described herein is intended as an example only, and other types of heat exchangers 22 having any number of passes are within the scope of the disclosure.

Advances in heat exchanger technology have led to use of heat exchanger coils in which some components of the coils are not primarily intended as participants in the transfer of heat between the refrigerant and air. When such non-heat transfer components are positioned near the vicinity of the fan inlet, the presence of the components within the airstream may adversely disrupt the flow path, causing flow to be deflected, disturbed, thereby increasing turbulence. As a result, the sound level produced by the fan is generally increased and the flow losses of the air passing through the system are generally increased, resulting in decreased system efficiency.

Figure 5:
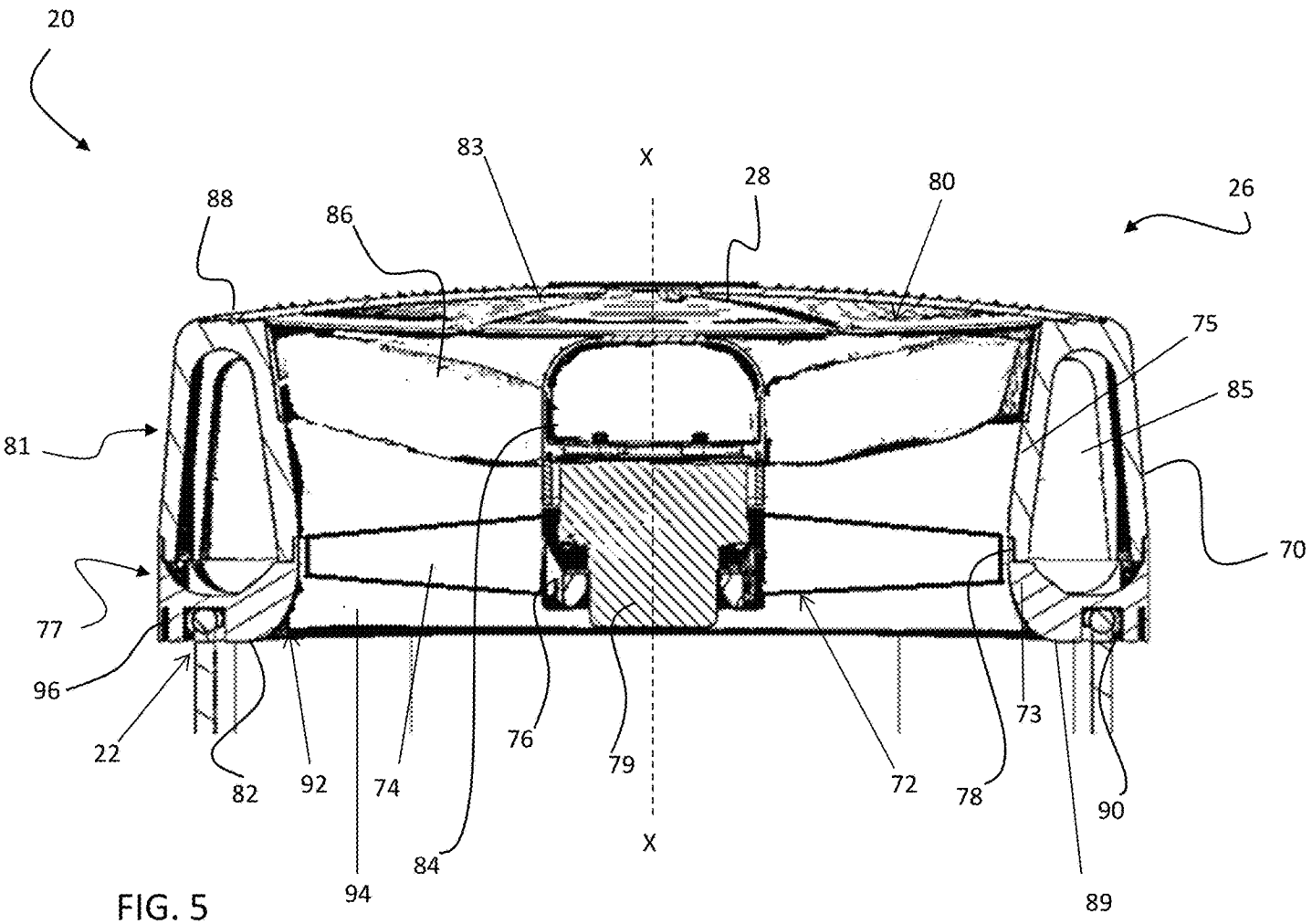
FIG. 5 is a cross-sectional view of the interface between the fan and the heat exchanger of the outdoor unit of FIG. 1 according to an embodiment.
Figure 6:
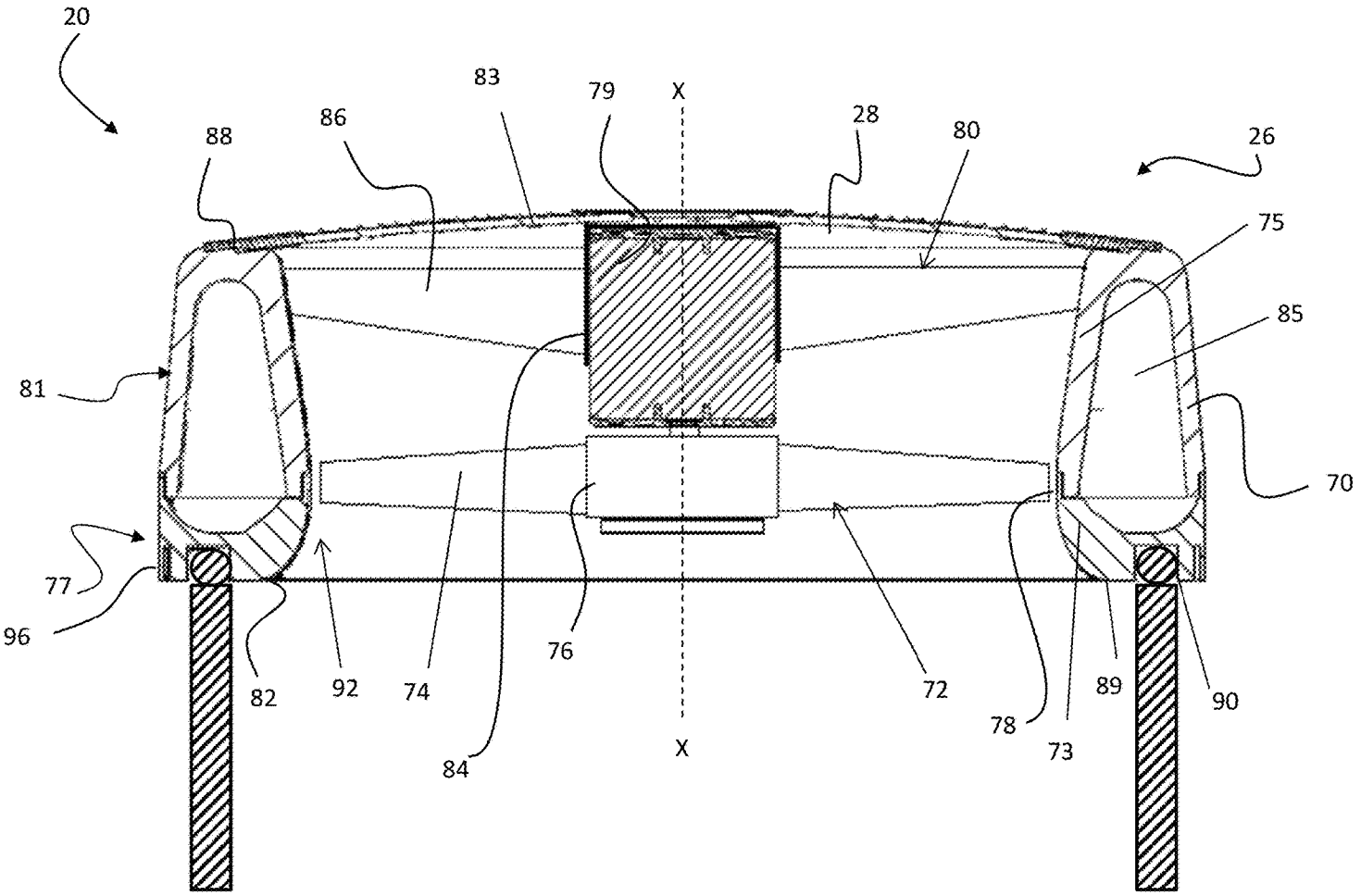
FIG. 6 is a cross-sectional view of a fan assembly of the outdoor unit of FIG. 1 according to an embodiment.
Figure 7:
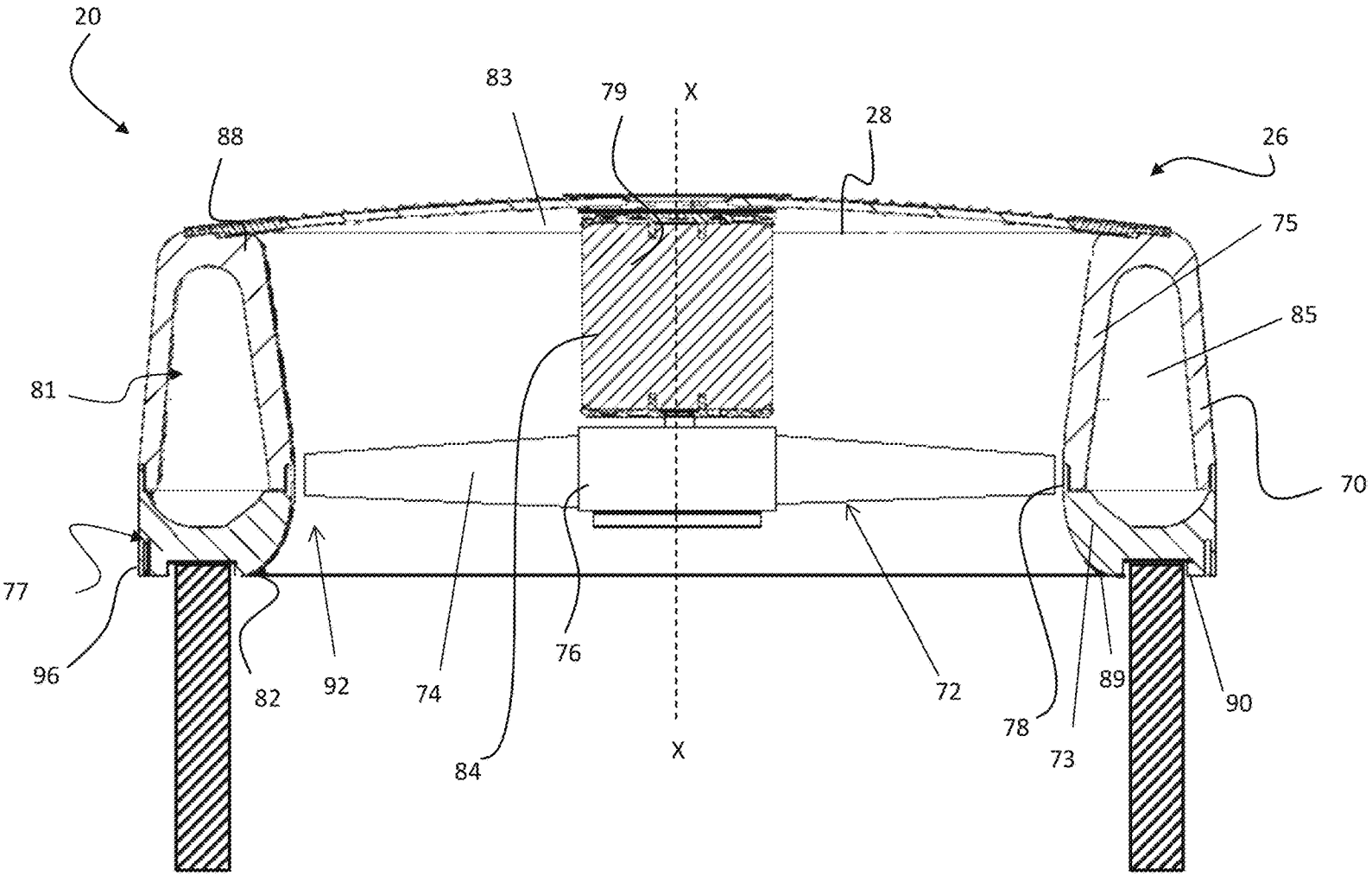
FIG. 7 is a cross-sectional view of a fan assembly of the outdoor unit of FIG. 1 according to an embodiment.

Referring now to FIGS. 5-7, various embodiments of a fan assembly 26 of the coil unit 20 having increased efficiency and a reduced noise signature are illustrated in more detail. The fan assembly 26 includes a housing 70 with a fan rotor or impeller 72 located within the housing 70. The fan rotor 72 includes a plurality of fan blades 74 extending from a hub 76 and terminating near an orifice throat 78, such as at a fan shroud for example. A motor 79 operably connected to the fan assembly 26, e.g., via a shaft or another coupling means, such as a belt, rope, or chain, may be used to operate the fan assembly 26 by rotating the fan rotor 72 about a fan axis X. The motor 79 may be oriented generally vertically, such that an axis of rotation of the motor 79 is arranged parallel to or coaxial with the fan axis X. However, other types of fans, such as a mixed flow fan for example, are within the scope of the present disclosure.

In an embodiment, the fan assembly 26 will typically include a finger guard 83, which in some embodiments may be used to support the motor 79. The finger guard 83 is typically formed with a plurality of openings sized to prevent the introduction of foreign objects into the fan assembly 26.

An interior surface of the housing 70 defines a central opening or passageway through which air is drawn by rotation of the impeller 72 about axis X. The cross-sectional area of the passageway taken in a plane oriented perpendicular to axis X may be configured to vary or may be substantially identical from an inlet end 82 of the housing to a discharge or outlet end 88 of the housing 70. In one embodiment, the housing 70 includes a convergent section adjacent an inlet end 82 and a divergent section adjacent the discharge end 88 such that the cross-sectional area of the passageway defined thereby varies accordingly.

The portion of the housing between the inlet end 82 and the discharge end 88, having the smallest cross-sectional area taken in a plane oriented perpendicular to axis X is defined as the throat 78. In one embodiment, the throat 78 is located at or near the intersection between the convergent and divergent portions 73, 75 of the housing 70. A ratio of the cross-sectional area of the throat 78 to the cross-sectional area of the taken at the discharge end 88 of the housing 70, also referred to as the fan outlet area, is between about 0.5 and 1, such as between about 0.6 and 0.9, and 0.5 and 0.8 for example. The overall fan height extends generally vertically between the inlet end 82 nearest the interior of the outdoor unit 20 and the discharge end 88, adjacent the opposite end of the housing 70. A fan diameter is generally measured at the throat 78 of the housing 70. In one embodiment, a ratio of the fan diameter to a height of the fan housing (measured between the housing inlet 82 and the housing outlet 88) is at least about 2 and is less than 5.

The fan assembly housing 70 may be formed from any suitable material, including but not limited to metal and plastic. In addition, the housing 70 may be formed as a single component, or alternatively, may comprise a plurality of components coupled by a connection means, such as a plurality of fasteners for example. The housing 70 may be formed by joining multiple housing sections, such as a first housing section 77 and a second housing section 81 for example. In an embodiment, the first housing section 77 is the convergent section 73 and the second housing section 81 is the divergent section 75. When the plurality of sections 77, 81 are connected, a hollow opening 85 is defined within an interior of the housing 70, between the sections 77, 81, as shown in FIGS. 5-7. Inclusion of the hollow opening 85 reduces the amount of material necessary to fabricate the housing 70, and therefore the weight of the housing 70.

Furthermore, by connecting a plurality of sections to form the housing 70, replacement of only a portion of the housing 70 in the event of failure or damage may be possible.

The inlet section 82 of the housing 70 is formed by revolving a curve, which can be approximated by a quarter segment of an ellipse, around the fan axis of rotation X. The profile of the elliptical shape is defined by a major axis and a minor axis. The ratio of the elliptical major axis, oriented parallel to the fan axis of rotation X, to the minor axis, arranged perpendicular to the fan axis of rotation X, is between about 1 and 3. Further, the length of the elliptical major axis is between about 5% to about 25% of the diameter of the fan rotor, or the fan diameter at the throat 78.

In an embodiment, the fan assembly 26 includes at least one stator assembly 80 operably coupled adjacent to the discharge end 88 of the housing 70. In such embodiments, the stator assembly 80 is configured as an outlet stator assembly. In the non-limiting embodiment illustrated in the FIG., the stator assembly 80 includes a hub 84 and a plurality of fins or outlet guide vanes 86 extending radially outward from the hub 84. The plurality of guide vanes 86 may be formed with any configuration, for example a planar configuration, or configurations including lean or sweep in the circumferential or axial directions. The distal ends of the one or more of the guide vanes 86 may, but need not be connected to the housing 70. In some embodiments, the outlet guide vanes 86 may be combined with the finger guard 83 to form an integrated structure. As the fan blades 74 rotate, the airflow A moving toward the guide vanes 86 generally has an axial component and a tangential component. The radial vanes 86 can be configured to straighten the flow exiting from the fan rotor 72, transforming swirl kinetic energy in the airflow into static pressure rises across the outlet guide vanes 86. In an example, the stator assembly 80 can be integrally formed with the housing 70, or with a section of the housing 70 when the housing is formed from multiple sections coupled together.

As previously described, the fan assembly 26 is configured to mount directly to a surface of the heat exchanger 22. In the illustrated, non-limiting embodiment of FIG. 5, the inlet end 88 of the housing 70 includes a horizontally and radially extending surface 89 having a recess 90 formed therein. The size of the recess 90, for example the width and depth thereof, can be chosen such that the recess can receive a portion of a header 30, 32, a portion of a tube 34, a portion of a fin 50, or a combination including at least one of the foregoing. For example, the width and/or depth of recess can be at least equal to the corresponding width and/or depth of a portion of the heat exchanger that does not participate in heat transfer, such as one of the headers 30, 32 of the heat exchanger 22 for example, such that when the fan assembly 26 is mounted to the heat exchanger 22, one of the headers 30, 32 is received within the recess 90. In an embodiment, the recess has a vertical depth of between about 2 mm and about 40 mm. In embodiments where the heat exchanger 22 includes a plurality of horizontally oriented tubes, an upper edge of the heat exchanger, such as including a horizontally extended tube for example, may be positioned between 2 mm and 8 mm within the recess 90. In embodiments where the heat exchanger 22 includes vertically oriented tubes and a horizontal header, the horizontal header may be positioned between 10 mm and 40 mm within the recess 90. When the header 30, 32 is positioned within the recess 90, a portion of the housing 70 can be arranged substantially flush with the adjacent end of the heat exchange coil configured to participate in heat transfer, such as the heat exchanger tube segments 34.

The portion 92 of the housing 70 arranged generally flush with a heat transfer portion of the heat exchanger 22, such as the heat exchange tube segments 34 for example, is referred to as an inlet orifice and has a contour including a generally convex curvature (e.g., where the inner surface of the housing, facing the fan shroud, has a bell shaped cross section in a plane containing the fan axis X). When the fan assembly 26 is mounted to the heat exchanger 22, the inlet orifice 92 is configured to direct airflow within the interior of the heat exchanger 22 towards the plurality fan blades 74 and away from the plurality of heat exchange tubes 34 and the header 32. In an embodiment, a second recess 96 is formed within the inlet end 82 of the housing 70. This second recess 96 may be configured to receive a structural support element. For example, a structural support element may include an outer housing formed a portion of the sides of an outdoor unit, a truss, a beam, an outer wall, or the like.

The fan assembly 26 disclosed herein is configured to minimize the turbulence and separation of the airflow entering the fan assembly 26 by preventing the air from tumbling over the exterior surface of a header 30, 32. This improves the efficiency of the air management system, resulting in a power reduction of up to about 40% while additionally reducing noise. The smooth curvature of the inlet section also reduces eddies from forming adjacent the housing inner surface which can reduce the efficiency of the fan assembly.

Embodiment 1: A fan assembly, comprising: a housing having an inlet and an outlet, wherein a recess formed in the inlet is configured to receive a portion of a heat exchanger; and a fan rotor positioned within the housing and being configured to rotate about a fan axis, the fan rotor including a hub having a plurality of fan blades mounted thereto.

Embodiment 2: The fan assembly according to claim 1, wherein a ratio of a diameter of the fan rotor to a height extending between the inlet and outlet of the housing is between about 2 and 5.

Embodiment 3: The fan assembly according to claim 1, wherein the fan housing includes a converging section adjacent the inlet end and a diverging section adjacent the discharge end.

Embodiment 4: The fan assembly according to claim 2, wherein the fan rotor is positioned within the housing such that the plurality of fan blades are arranged adjacent an intersection between the converging section and the diverging section.

Embodiment 5: The fan assembly according to claim 2, wherein a throat is defined in the housing between the converging section and the diverging section, and a ratio of a cross-sectional area of throat to a cross-sectional area of the housing at the outlet is between about 0.5 and 1.

Embodiment 6: The fan assembly according to claim 1, wherein the converging section of the housing has a generally elliptical shape including a profile major axis and a profile minor axis, wherein a ratio of the profile major axis to the profile minor axis is between about 1 and 3.

Embodiment 7: The fan assembly according to claim 1, wherein the converging section of the housing has a generally elliptical shape including a profile major axis and a profile minor axis, wherein a ratio of the profile major axis to a diameter of the fan rotor is between about 0.05 and about 0.25.

Embodiment 8: The fan assembly according to claim 1, wherein the housing adjacent the inlet includes a substantially horizontally and radially extending surface, wherein the recess is formed within the substantially horizontally and radially extending surface.

Embodiment 9: The fan assembly according to claim 1, wherein the recess has a vertical depth between about 2 mm and 40 mm.

Embodiment 10: The fan assembly according to claim 1, wherein at least a portion of a heat exchanger is receivable within the recess, an upper edge of the heat exchanger being positioned between 2 mm and 8 mm within the recess.

Embodiment 11: The fan assembly according to claim 1, wherein a header of a heat exchanger tube is receivable within the recess, an upper edge of the header being positioned between 10 mm and 40 mm within the recess.

Embodiment 12: The fan assembly according to claim 1, further comprising a stator assembly located adjacent the outlet, the stator assembly including a plurality of outlet guide vanes.

Embodiment 13: The fan assembly according to claim 12, further comprising a finger guard connected to the outlet of the housing, wherein the plurality of outlet guide vanes are integrated with the finger guard.

Embodiment 14: The fan assembly according to claim 1, wherein the housing is formed from a first housing section and a second housing section coupled together.

Embodiment 15: The fan assembly according to claim 14, wherein at least one of the first housing section and the second housing section is formed from a plastic material.

Embodiment 16: The fan assembly according to claim 14, wherein at least one of the first housing section and the second housing section is formed from a metal material Embodiment 17: An outdoor coil unit, comprising: a heat exchanger having a first header, a second header, and a plurality of heat exchange tube segments extending between and fluidly coupling the first header and the second header; and a fan mounted to a portion of the heat exchanger. The fan including: a housing having an inlet and an outlet, a recess being formed in the housing adjacent the inlet, wherein a portion of the heat exchanger is positioned within the recess; and a fan rotor positioned within the housing and being configured to rotate about a fan axis, the fan rotor including a hub having a plurality of fan blades mounted thereto.

Embodiment 18: The outdoor unit according to either claim 17, wherein the heat exchanger has a multi-pass configuration.

Embodiment 19: The coil unit of any of the preceding claims, further comprising a fan motor operably coupled to the fan rotor, a floor pan configured to hold the heat exchanger, a grille coupled to the discharge end of the housing, or a combination comprising at least one of the foregoing.

While the present disclosure has been particularly shown and described with reference to the exemplary embodiments as illustrated in the drawing, it will be recognized by those skilled in the art that various modifications may be made without departing from the spirit and scope of the present disclosure. Therefore, it is intended that the present disclosure not be limited to the particular embodiment(s) disclosed as, but that the disclosure will include all embodiments falling within the scope of the appended claims.

What is claimed is:

1. A fan assembly, comprising:

a housing having an inlet end and an outlet end, wherein the inlet end includes a radially extending surface;

a recess formed into a surface of the inlet end, the recess being sized to receive a portion of a heat exchanger within the recess; and a fan rotor positioned within the housing and being configured to rotate about a fan axis, the fan rotor including a hub having a plurality of fan blades mounted thereto.

2. The fan assembly according to claim 1, wherein a ratio of a diameter of the fan rotor to a height extending between the inlet and outlet of the housing is between 2 and 5.

3. The fan assembly according to claim 1, wherein the housing includes a converging section adjacent the inlet end and a diverging section adjacent the outlet.

4. The fan assembly according to claim 3, wherein the fan rotor is positioned within the housing such that the plurality of fan blades are arranged adjacent an intersection between the converging section and the diverging section.

5. The fan assembly according to claim 3, wherein a throat is defined in the housing between the converging section and the diverging section, and a ratio of a cross-sectional area of the throat to a cross-sectional area of the housing at the outlet is between 0.5 and 1.

6. The fan assembly according to claim 3, wherein the converging section of the housing has a generally elliptical shape including a profile major axis and a profile minor axis, wherein a ratio of the profile major axis to the profile minor axis is between 1 and 3.

7. The fan assembly according to claim 3, wherein the converging section of the housing has a generally elliptical shape including a profile major axis and a profile minor axis, wherein a ratio of the profile major axis to a diameter of the fan rotor is between 0.05 and 0.25.

8. The fan assembly according to claim 1, wherein the housing adjacent the inlet includes a substantially horizontally and radially extending surface, wherein the recess is formed within the substantially horizontally and radially extending surface.

9. The fan assembly according to claim 1, wherein the recess has a vertical depth between 2 mm and 40 mm.

10. The fan assembly according to claim 1, wherein at least a portion of a heat exchanger is receivable within the recess, an upper edge of the heat exchanger being positioned between 2 mm and 8 mm within the recess.

11. The fan assembly according to claim 1, wherein a header of a heat exchanger tube is receivable within the recess, an upper edge of the header being positioned between 10 mm and 40 mm within the recess.

12. The fan assembly according to claim 1, further comprising a stator assembly located adjacent the outlet, the stator assembly including a plurality of outlet guide vanes.

13. The fan assembly according to claim 12, further comprising a finger guard connected to the outlet of the housing, wherein the plurality of outlet guide vanes are integrated with the finger guard.

14. The fan assembly according to claim 1, wherein the housing is formed from a first housing section and a second housing section coupled together.

15. The fan assembly according to claim 14, wherein at least one of the first housing section and the second housing section is formed from a plastic material.

16. The fan assembly according to claim 14, wherein at least one of the first housing section and the second housing section is formed from a metal material.

17. An outdoor coil unit, comprising:

a heat exchanger having a first header, a second header, and a plurality of heat exchange tube segments extending between and fluidly coupling the first header and the second header; and a fan mounted to a portion of the heat exchanger, the fan including:

a housing having an inlet and an outlet, a recess being formed in the housing adjacent the inlet, wherein a portion of the heat exchanger is positioned within the recess; and a fan rotor positioned within the housing and being configured to rotate about a fan axis, the fan rotor including a hub having a plurality of fan blades mounted thereto.

18. The outdoor coil unit according to claim 17, wherein the heat exchanger has a multi-pass configuration.

19. The outdoor coil unit of claim 17, further comprising a fan motor operably coupled to the fan rotor, a floor pan configured to hold the heat exchanger, a grille coupled to the outlet of the housing, or a combination comprising at least one of the foregoing.

* * * * *